US010155229B2

(12) United States Patent
Baldauf et al.

(10) Patent No.: US 10,155,229 B2
(45) Date of Patent: Dec. 18, 2018

(54) NANOBUBBLES FOR ENHANCED INTERACTION BETWEEN SOLIDS AND GAS VOLUMES

(71) Applicant: International Business Machines Corporation, Armonk, NY (US)

(72) Inventors: Julia S. Baldauf, South Melbourne (AU); Alexe Bojovschi, Melbourne (AU); Stephen M. Moore, Melbourne (AU); Priscilla R. Rogers, Fitzroy (AU); Christine Schieber, Southbank (AU)

(73) Assignee: International Business Machines Corporation, Armonk, NY (US)

( * ) Notice: Subject to any disclaimer, the term of this patent is extended or adjusted under 35 U.S.C. 154(b) by 589 days.

(21) Appl. No.: 14/822,325

(22) Filed: Aug. 10, 2015

(65) Prior Publication Data

US 2017/0043356 A1 Feb. 16, 2017

(51) Int. Cl.

| | |
|---|---|
| ***B03D 1/02*** | (2006.01) |
| ***B03D 1/04*** | (2006.01) |
| ***B03D 1/14*** | (2006.01) |

(52) U.S. Cl.

CPC ..... *B03D 1/028* (2013.01); *B03D 1/02* (2013.01); *B03D 1/04* (2013.01); *B03D 1/1431* (2013.01)

(58) Field of Classification Search

None

See application file for complete search history.

(56) References Cited

U.S. PATENT DOCUMENTS

| | | | |
|---|---|---|---|
| 4,397,741 | A | 8/1983 | Miller |
| 4,981,582 | A | 1/1991 | Yoon |
| 5,303,871 | A | 4/1994 | Bateson |
| 5,397,001 | A | 3/1995 | Yoon |
| 5,690,834 | A | 11/1997 | Bennoit |
| 5,728,304 | A | 3/1998 | Yeh |
| 5,814,210 | A | 9/1998 | Yoon |
| 8,349,177 | B2 | 1/2013 | Menju |

(Continued)

FOREIGN PATENT DOCUMENTS

| | | |
|---|---|---|
| JP | 2010162518 | 7/2010 |
| JP | 2013140096 | 7/2013 |

OTHER PUBLICATIONS

Tao, D, "Role of Bubble Size in flotation of Coarse and Fine Particles—A Review", Separation Science and Technology (2004) 39(4): p. 741-760.*

(Continued)

*Primary Examiner* — Thomas M Lithgow

(74) *Attorney, Agent, or Firm* — David Quinn; Otterstedt, Ellenbogen & Kammer, LLP

(57) ABSTRACT

Nanobubbles are employed to bridge microbubbles and non-buoyant particles, thereby creating sufficient capillary forces between the particles and microbubbles such that relatively large, heavy particles can be separated from an aqueous slurry. Nanobubbles are formed on hydrophobic particle surfaces. The microbubbles, which function as collecting air bubbles, form attachments with the particles. The nanobubbles create additional capillary attachment forces between the particles and microbubbles, allowing the microbubbles to rise with the attached particles to the top of the slurry for separation and recovery.

12 Claims, 5 Drawing Sheets

(56) References Cited

U.S. PATENT DOCUMENTS

| | | | |
|---|---|---|---|
| 8,500,104 | B2 | 8/2013 | Spears |
| 2007/0036722 | A1 | 2/2007 | Rongved |
| 2014/0158631 | A1 | 6/2014 | Govind |

OTHER PUBLICATIONS

Schubert, H., Nanobubbles, hydrophobic effects, heterocoagulation and hydrodynamics in flotation, International Journal of Mineral Processing 78, 2005, pp. 11-21.
Stockelhuber, K. W. et al., Rupture of wetting film caused by nanobubbles, Langmuir 2004, Nov. 26, 2003, pp. 164-168.
Hampton, M. A. et al., Nanobubbles and the nanobubble bridging capillary force, Advances in Colloid and Interface Science 154, 2010, pp. 30-55.
Simonsen, A. C. et al., Nanobubbles give evidence of incomplete wetting at a hydrophobic interface, Journal of Colloids and Interface Science 273, 2004, pp. 291-299.
Zhou, Z. A. et al., Role for hydrodynamic cavitation in fine particle flotation, Int. J. Miner. Process 51, 1997, pp. 139-149.
Rubio, J. et al., Overview of flotation as a wastewater treatment technique, Minerals Engineering 15, 2002, pp. 139-155.
Fan Maoming et al. Nanobubble generation and its application in froth flotation (part I): nanobubble generation and its effects on properties of microbubble and millimeter scale bubble solutions, Mining Science and Technology 20, 2010, pp. 0001-0019.
Sobhy, A. et al., Nanobubble column flotation of fine coal particles and associated fundamentals, International Journal of Mineral Processing 124, 2013, pp. 109-116.

* cited by examiner

B
36
PARTICLE
G
34

34
OR
42
COLLECTOR
FROTHER
40
34

COLLECTOR AND FROTHER
46
34

CAPILLARY BRIDGE

NANOBUBBLES FOR ENHANCED INTERACTION BETWEEN SOLIDS AND GAS VOLUMES

FIELD

The present disclosure relates to the use of nanobubbles to facilitate the capture of relatively large (millimeter magnitude diameter) particles as well as particles having dimensions of less than a millimeter.

BACKGROUND

Froth flotation is a process used to selectively separate hydrophobic from hydrophilic materials. While applicable in a number of industries, one area of great importance is the mining industry where it is commonly used for the recovery of metal sulfide ores or coal, for example. The key steps in the process involve initially grinding the ore (a process known as 'comminution') to a relatively fine particle size in order to 'liberate' the valuable mineral from the remaining commercially worthless material (known as 'gangue'). Following this step, the ground ore is mixed with water to form a 'slurry' and a surfactant (or 'collector') is commonly added to bind to the surface of the desired mineral to render it hydrophobic. The slurry is introduced into an aerated flotation cell (often mechanically agitated with an impeller) such that the hydrophobic particles collide and bind with the air bubbles and rise to the surface of the cell, forming a froth of purified mineral which is then collected. The recovery of a mineral exhibits a strong dependence on the size of the particles, with an approximate upper limit being in the range of ten to one hundred microns (10-100 μm). Relatively small particles do not have enough inertia to deviate from the streamlines around an air bubble and collide with it. Detachment from the bubble can occur as a result of the shear forces within the turbulent flow in the case of relatively large particles or the gravitational force acting on the coarser particles exceeding the buoyancy and/or bubble-particle attraction forces. Despite the success of the froth flotation process, the costs associated with grinding an ore to submicron size are extremely high and require high energy consumption. It has been reported that an approximate thirty-seven percent (37%) in energy savings could be gained if the upper limit of the particle size could be increased to one millimeter (1 mm), but this would require a means for preventing detachment from the air bubbles.

One approach for enhancing coarse particle recovery is the use of very small bubbles in the slurry, often referred to as 'picobubbles' or 'nanobubbles' due to their nanometer-scale length dimensions. Nano-bubbles form naturally or can be generated artificially. It has been reported that that the presence of nanobubbles can improve recovery by five to fifty percent (5-50%). After the nano/micro-bubbles are injected, they attach to particles or stay dispersed in the solution.

Current particles recovery technologies are limited currently at about one hundred microns (100 μm) for minerals and six hundred (600 μm) for coal. Enabling coarse flotation has the potential to reduces the energy in the process chain with significant economical benefits.

SUMMARY

Principles of the present disclosure provide an exemplary froth flotation method that includes obtaining an aqueous slurry comprising a liquid and solid particles within the liquid and causing the formation of nanobubbles and collecting air bubbles within the aqueous slurry, the collecting air bubbles having diameters at least two orders of magnitude greater than the diameters of the nanobubbles, at least some of the nanobubbles being formed on or adhering to the solid particles. Gas supersaturation of the aqueous slurry is obtained. One or more surfactants are introduced to the slurry. The method further includes attaching the solid particles to the collecting air bubbles using capillary bridges formed by the nanobubbles between the solid particles and the collecting air bubbles, thereby causing the solid particles to rise within the slurry.

As used herein, "facilitating" an action includes performing the action, making the action easier, helping to carry the action out, or causing the action to be performed. Thus, by way of example and not limitation, instructions executing on one processor might facilitate an action carried out by instructions executing on a remote processor, by sending appropriate data or commands to cause or aid the action to be performed. For the avoidance of doubt, where an actor facilitates an action by other than performing the action, the action is nevertheless performed by some entity or combination of entities.

Particle separation methods as disclosed herein can provide substantial beneficial technical effects. For example, one or more embodiments may provide one or more of the following advantages:

- Nanobubbles act as capillary bridges between a solid particle and a collecting air bubble, creating an additional attachment force between the two entities;
- As a result of the additional attachment force, relatively large particles can be captured;
- The capture of relatively large particles reduces the need to fine grind the ore during comminution;
- The capture of relatively large particles reduces the energy consumption, and cost, needed to perform comminution;
- The increased attachment force decreases detachment probability between air bubbles and particles, hence increasing the recovery of both large (mm size) particles and small particles;
- The decreased detachment probably also allows recovery in more turbulent flow which increases the attachment probability, possibly allowing novel cell designs.

These and other features and advantages will become apparent from the following detailed description of illustrative embodiments thereof, which is to be read in connection with the accompanying drawings.

DETAILED DESCRIPTION

Exemplary embodiments of the present disclosure provide methods for the enhanced interaction between solid particles and gas volumes to facilitate the recovery of large and/or small particles. A mechanism is provided in which nanobubbles, formed on a particle surface, or systems of nanobubbles, create an increased attachment force through a "capillary bridge" or multiple capillary bridges between the particle and a collecting air bubble, resulting in the ability to increase the recovery of coarse, non-buoyant particles. Through chemical modification, such as stabilization by surfactants, the nanobubble(s) are not engulfed by the collecting air bubble. Instead, the nanobubble(s) stably join the solid particle and collecting air bubble, creating an additional attachment force that would not otherwise be present. In some exemplary embodiments, the particles comprise minerals to be separated from unwanted solid materials contained in a slurry.

Figure 1:
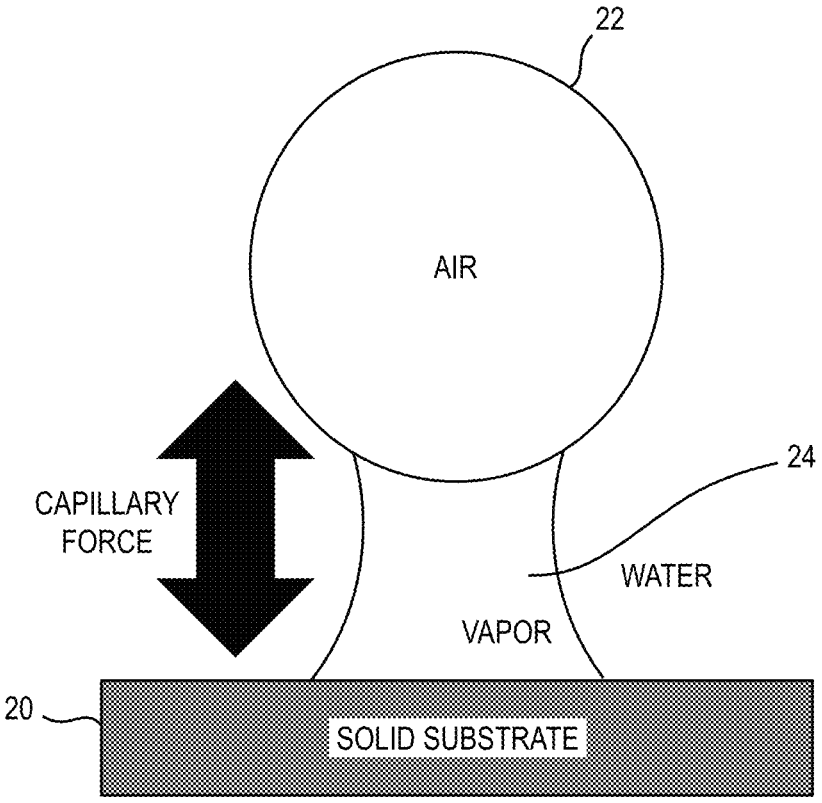
FIG. 1 is a schematic illustration showing capillary force between a solid surface and an air bubble.

Nanobubbles employed to improve the attachment between a solid particle 20 and a collecting air bubble 22 are formed on a particle surface and therefore positioned between the particle surface and the collecting air bubble such that it forms a capillary bridge 24 between the two entities, as shown in FIG. 1. Such capillary bridges are enabled by chemical modifications to form and stabilize nanobubbles between a solid surface and an air bubble, which results in an attractive force (designated by the double-arrow). An equilibrium state is obtained that ensures the nanobubbles do not collapse following formation. It has been found that when the density of gas dissolved in the liquid falls under a specific value, particle recovery is reduced due to the collapse of the nanobubbles. The necessary temporal stability of nanobubbles is obtained in some embodiments, in part, by providing a supersaturated solution. The supersaturation ensures a balance between the diffusion of gas molecules in and out of nanobubbles. Supersaturation of a liquid can be achieved and maintained under certain temperature, pressure or volume conditions, as governed by the ideal gas law. Supersaturation would be achieved via a continuous control of dissolved gas in the flotation cell to ensure that nano-bubbles do not collapse. This will ensure that the gas content would be larger than in normal conditions when the solution is exposed to the air. Pressure above atmospheric pressure is maintained within the flotation cell in one or more embodiments.

In some embodiments, nanobubble size is controlled to optimise recovery. Through controlling nanobubble production parameters, e.g. acoustic cavitation discussed later, nanobubbles can be generated to a volume, which results in the optimal coarse particle recovery. This is the volume that generates sufficient attractive force through the capillary bridge(s) for the collecting air bubble to float the coarse particle to the surface. In other words, it contributes to a force balance that results in a net upward force causing the coarse particle to float. As such, the optimal size of the nanobubble is contingent on parameters of the collecting air bubble and coarse particle, such as diameters, weight, and buoyancy. If the nanobubble size results in insufficient attractive forces, the capillary bridge will not be sufficient to hold the coarse particles to the collecting air bubble. If the nanobubble size results in a stronger than needed attractive force, and there is a net downward force, collecting air bubbles will be dragged to the bottom of flotation cell. Furthermore, nanobubbles can be selectively positioned between coarse particles and collecting air bubbles, and clustered into systems of nanobubbles to form multiple capillary bridges, based on the exploitation of surfactants, and other parameters. Based on the type of minerals known to be present in a flotation cell, specific surfactants are added to render the surface area of targeted particles hydrophobic and in this way selectively control the attachment of nanobubbles to the targeted particles. The selective attachment of the nanobubbles is accordingly controlled by adjusting the hydrophobicity of surfaces by the use of appropriate surfactants and controlling the concentration of the surfactants within the aqueous slurry.

In some embodiments, a sensor is employed to monitor the gas density in a flotation cell to ensure the stability of the nanobubbles. For flotation cells the gas density is usually measured by capturing a known volume of the slurry and measuring the volume occupied by gas. Electrochemical gas sensors used in industry can be adopted to accurately determine the gas content in a liquid/solution. U.S. Pat. Nos. 3,394,069 5,121,627, which are incorporated by reference herein, disclose exemplary sensors that may be employed in accordance with one or more embodiments.

The gas injection system employed to form the nanobubbles is operatively associated with the gas density monitor in some embodiments, as discussed further below. Gas injection is accordingly controlled as necessary based on information received by a processor from the gas sensor. Chemical modification of the nanobubbles formed in the slurry inhibit their coalescence and thereby further facilitate formation of capillary bridges. A large array of exemplary surfactants used to enhance the flotation of specific minerals is known to the art. For example, the flotation of coal particles using fuel oil as the collector (dosage of 0.49 kg/ton) and methyl isobutyl carbinol (MIBC) as the frother (concentration of 30 ppm) has been discussed in the literature. A mixture of sodium oleate and sulfosuccinate/sulfosuccinamate may be used for the flotation of apatite. The flotation of quartz particles involves the use of alkyl ether monoamine as collector (surfactant) together with nanobubbles. The prevention of bubble-bubble coalescence is driven by a number of factors including the collision velocity, surfactant type, contact time and bubble size. It is to be noted that even bubbles with the same surfactants absorbed on their surface do not necessary coalesce. The presence of two different tailored surfactants can however prevent the collision coalescence even when the collision velocity is high. It will be appreciated that the particular surfactants chosen will depend on the specific mineral particles to be floated as well as the inhibition or prevention of bubble-bubble coalescence.

Figures 2A, 2B, 3A, 3B:
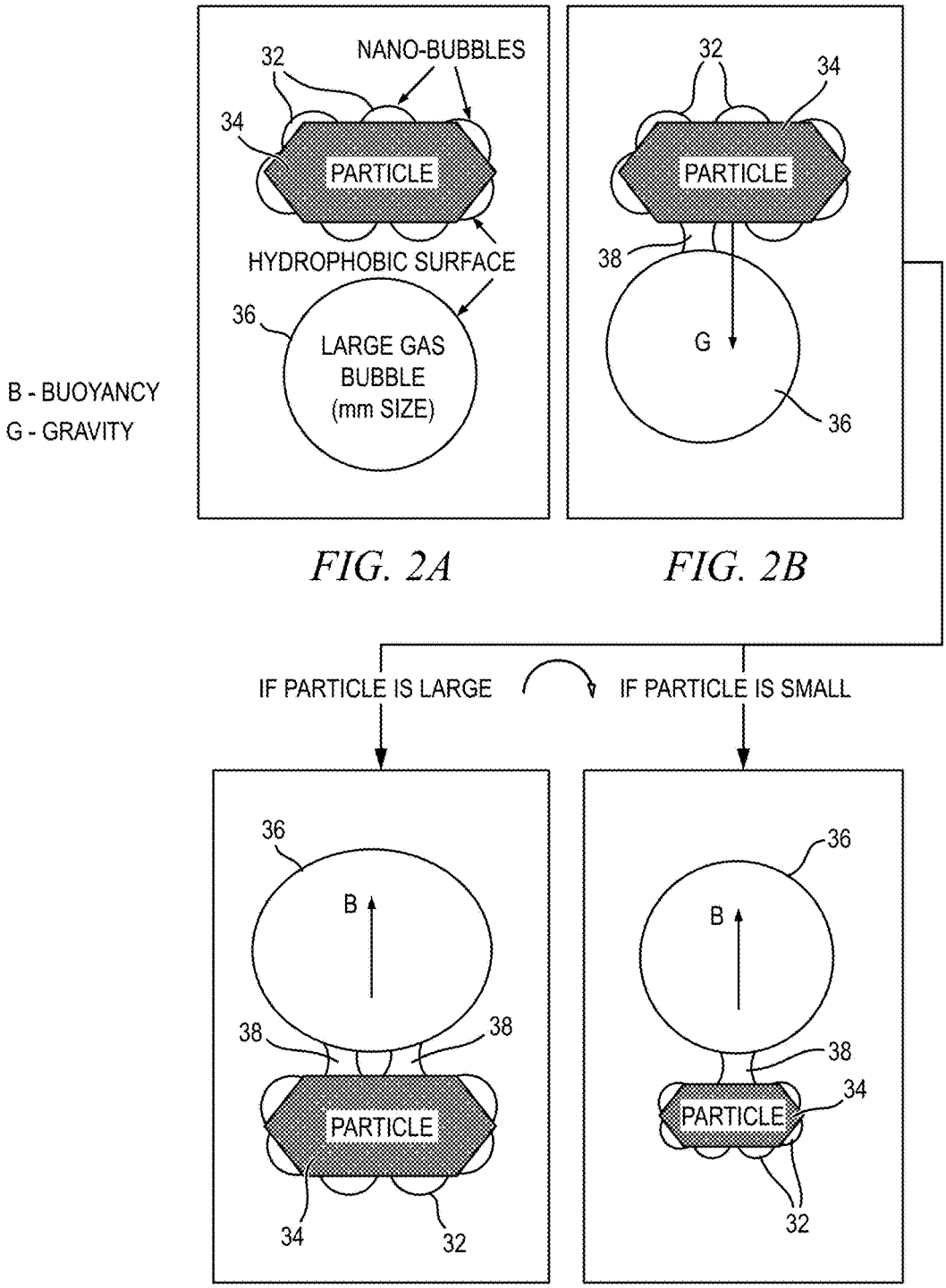
FIG. 2A is a schematic illustration of a slurry containing a particle having a hydrophobic surface covered by nanobubbles and a large gas bubble.
FIG. 2B is a schematic illustration showing interaction of the large gas bubble with the particle covered by the nanobubbles.
FIG. 3A is a schematic illustration showing the attachment of the large gas bubble to a relatively large particle.
FIG. 3B is a schematic illustration showing the attachment of the large gas bubble to a relatively small particle.

Referring to FIG. 2A, nanobubbles 32 are formed on the hydrophobic surface of a particle 34 to be separated. The formation of capillary bridges requires the presence of hydrophobic surfaces on the particles or hydrophobized particles. An air bubble 36 substantially larger in size than the nanobubbles 32 is in the vicinity of the particle 34. In some embodiments, the air bubble 36 has a diameter measured in millimeters (i.e., at least one millimeter in diameter) while the nanobubbles diameters are measured in nanometers and are less than one micron. As known in the art, one nanometer is equal to 1E-06 millimeters. The air bubbles 36, also referred to herein as collecting air bubbles or coarse air bubbles, are at least two orders of magnitude larger than the nanobubbles. The interaction of a collecting air bubble 36 with the particle 34 is shown in FIG. 2B. In this schematic illustration, a capillary bridge 38 formed by the nanobubble between the particle surface and the collecting air bubble 36. It will be appreciated that a plurality of capillary bridges between each particle and collecting air bubble will be formed in some embodiments. Surfactants chosen for incorporation within the slurry facilitate the formation of such capillary bridges as opposed to coalescence of the bubbles that could otherwise occur.

FIG. 3A shows the interaction of a collecting air bubble 36 with a relatively large particle 34. For the purposes of this disclosure, a relatively large particle has a diameter that is measurable in millimeters (for example, a millimeter or greater). Particles often have irregular configurations and therefore have multiple diameters. Large particles have one or more diameters measured in millimeters. Gravitational forces G ordinarily prevent large particles from floating to or remaining near the surface in a slurry. Upon the joining of a large particle to a collecting air bubble by capillary bridges formed by the stabilized nanobubbles, the buoyancy B is sufficient to allow both the particle and collecting air bubble to rise towards the surface of the slurry where the particle can be recovered. FIG. 3B schematically illustrates the interaction of a collecting air bubble with a relatively small particle. Small particles are characterized by micron size diameters. Recovery of small particles can accordingly be enhanced by the formation of capillary bridges between particle surfaces and collecting air bubbles, the nanobubbles on the particle surfaces facilitating formation of such capillary bridges.

Figures 4A, 4B, 4C, 4D:
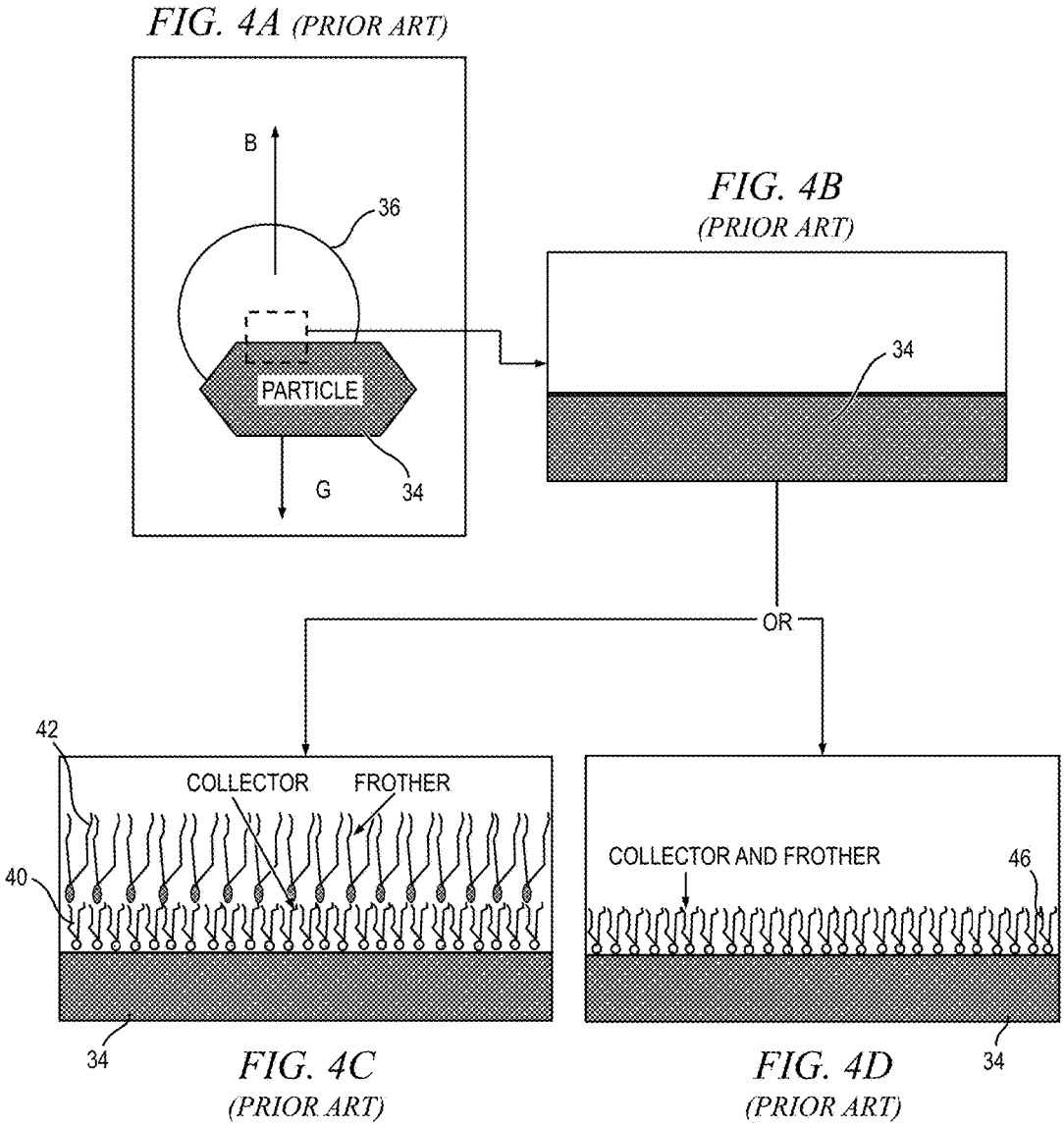
FIG. 4A (PRIOR ART)
FIG. 4B (PRIOR ART)
FIG. 4C (PRIOR ART)
FIG. 4D (PRIOR ART)
FIGS. 4A-4D are schematic illustrations showing the attachment of a particle and a carrier bubble using prior art techniques.

Distinctions between some prior art particle recovery techniques and those provided in accordance with the present disclosure are highlighted by FIGS. 4A-D and FIGS. 5A-D. FIGS. 4A-D schematically illustrate prior art techniques showing the interaction between particles 34 and collecting air bubbles 36 wherein nanobubbles are not formed on the particle surfaces prior to such interaction. Prior art techniques include the use of surfactants to enhance the hydrophobicity, stability and attachment between a collecting air bubble and a particle. The surfactants used to hydrophobize particle surfaces are called collectors while those that stabilize bubbles are called frothers. In some cases, the collectors function similarly to frothers. In FIG. 4C, the interaction of collectors 40 on the particle surface and frothers 42 is schematically illustrated. In FIG. 4D, a prior art embodiment wherein collectors 46 also play a role as frothers is shown.

Figure 5A:
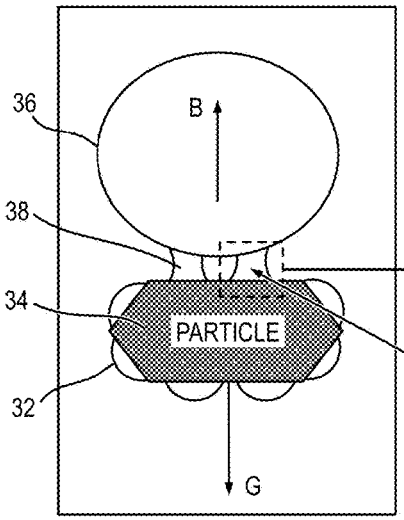
FIG. 5A is a schematic illustration showing the attachment of a particle and a carrier bubble using capillary bridges.
Figure 5B:
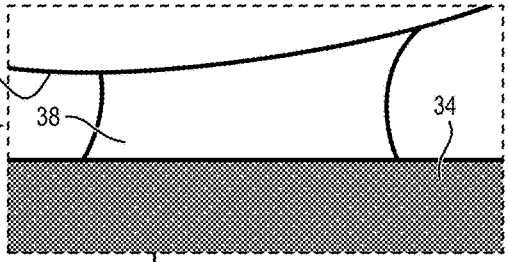
FIG. 5B is an enlarged schematic illustration showing the particle surface and one of the capillary bridges.
Figure 5C:
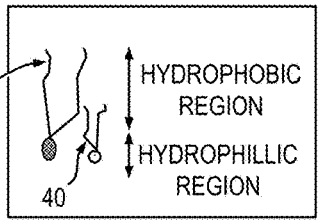
FIG. 5C is a greatly enlarged schematic illustrations of a collector and a frother.
Figure 5D:
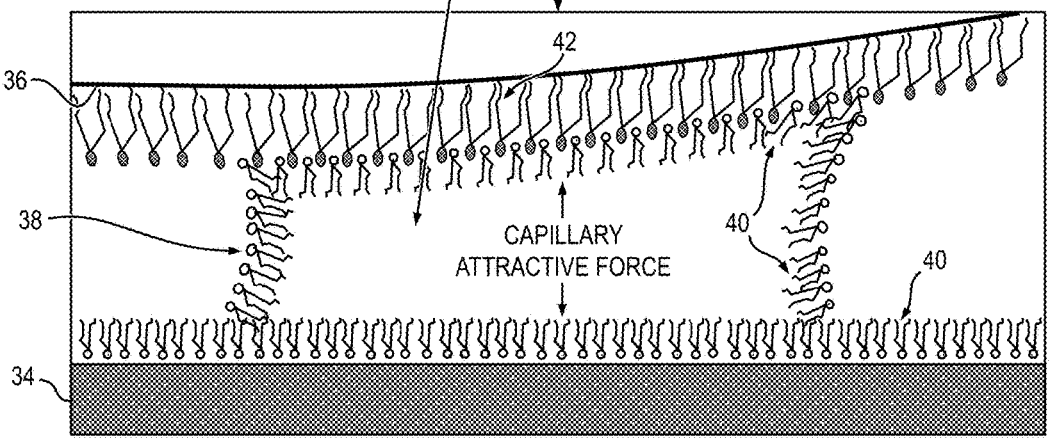
FIG. 5D is a greatly enlarged view showing one of the capillary bridges between the particle surface and a collector air bubble.

Referring to FIG. 5A, a large solid particle 34 is shown interacting with a collecting air bubble 36. (FIG. 3A similarly shows such interaction.) A greatly enlarged view of a portion of the bubble/particle interface is schematically illustrated in FIG. 5B, and shows one of the capillary bridges 38 formed between the collecting air bubble and the particle. The immiscible surfactants 40, 42 include hydrophilic regions and hydrophobic regions, as shown schematically in FIG. 5C. As described above with respect to FIG. 3C, collectors 40 are provided on the particle surface to render the particle hydrophobic. The collectors can be selective to the particles intended to be recovered. The hydrophilic heads of the collectors interact with the particle surface while the water-insoluble hydrophobic tails extend away from the heads. The capillary bridges formed by the nanobubbles at the interface between a particle and the large collecting air bubble 36 enhance the attachment of the double surfactant layer of nanobubble and bubble to the particle through capillary forces. As illustrated, the surfactants on the large bubbles should be immiscible with those on the nanobubbles. In the flotation process, surfactants can play the role of collector or frothers or both. As shown in FIG. 5D, the surfactant that is used to activate (activator=collector) the surface of the particle is also a frother in the sense that it can be absorbed on the surface of nano-bubbles. For the larger bubble a different surfactant is used to functionalize it. This process can be selectively controlled for example by injecting nanobubbles coated with a specific surfactant in the flotation cell.

Figure 6:
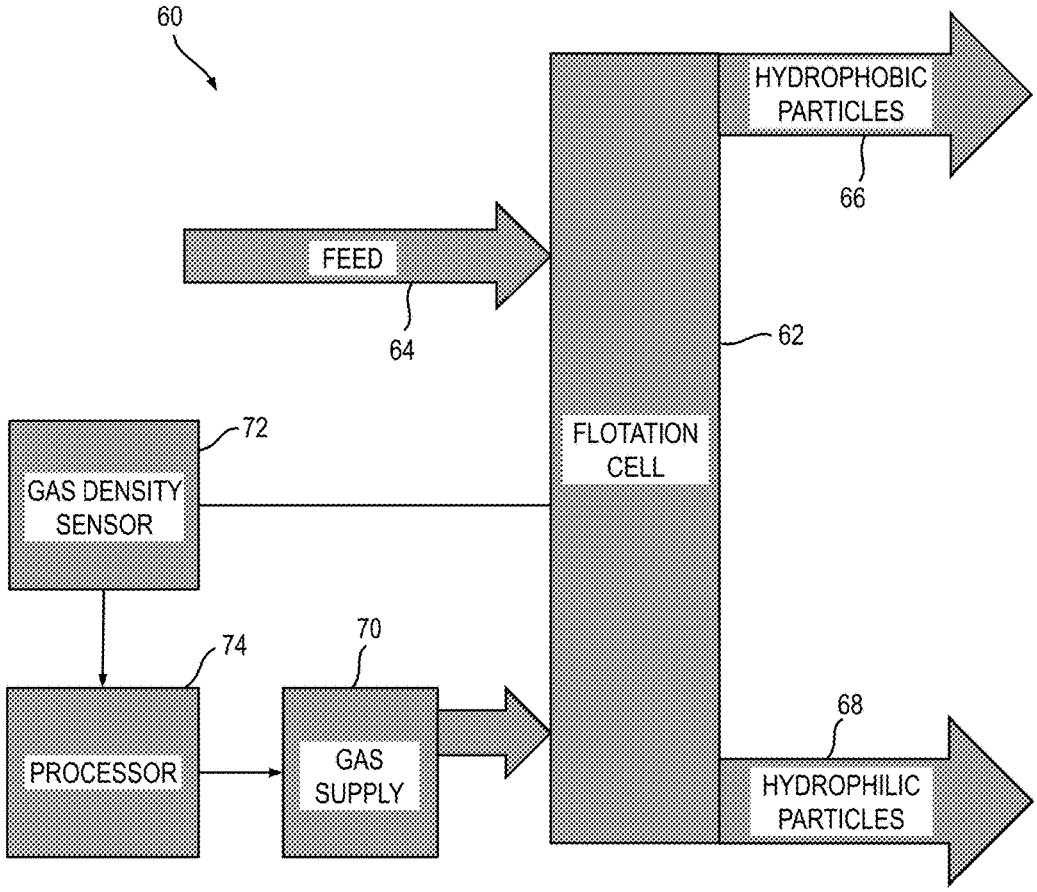
FIG. 6 is a diagram of an exemplary froth flotation system.

FIG. 6 shows an exemplary froth flotation system 60. The system includes a flotation cell 62 operatively associated with a feed 64, an outlet 66 for discharging particles floated using techniques as disclosed herein, and an outlet 68 for untargeted particles. A gas supply 70 includes means for introducing gas into the slurry and can be partially or entirely within the flotation cell itself. Large bubbles can be formed via conventional means in the froth flotation cell. This includes 1) the electrolysis of diluted aqueous, conducting solutions with the production of gas bubbles at both electrodes; 2) mechanical formation by a combination of a high-speed mechanical agitator and an air injection system; and 3) reduction in pressure of water pre-saturated with air at pressures higher than atmospheric. Nanobubbles could be generated by cavitation, possibly by fluid flow, which is referred to as hydrodynamic cavitation, and is produced by pressure variation in a flowing liquid caused by the velocity variation in the system. The other is by an acoustic field, which is often referred to as acoustic cavitation. Cavitation also can be achieved in nature by local energy deposit: either by photons of laser light or by other elementary particles (e.g., protons in a bubble chamber), which are often referred to as optical cavitation and particle cavitation respectively. A gas density sensor 72 monitors dissolved gas in the cell 62. Output from the sensor 72 is transmitted, possibly wirelessly, to a processor 74 that determines whether the dissolved gas level is within selected parameters that are suitable for nanobubble stability. The processor 74 controls the operation of the gas supply 70 to maintain the desired gas density.

Given the discussion thus far and with reference to the exemplary embodiments discussed above and the drawings, it will be appreciated that, in general terms, an exemplary fabrication method includes obtaining an aqueous slurry comprising a liquid and solid particles 34 within the liquid and causing the formation of nanobubbles 32 and coarse bubbles 36 within the aqueous slurry, the coarse bubbles 36 having diameters at least two orders of magnitude greater than the diameters of the nanobubbles, at least some of the nanobubbles being formed on or adhering to the solid particles. Supersaturation is obtained and maintained during the process. One or more surfactants 40, 42 are introduced to the slurry. The method further includes attaching the solid particles to the coarse bubbles using capillary bridges 38 formed by the nanobubbles between the solid particles and the coarse bubbles, thereby causing the solid particles to rise within the slurry. The targeted solid particles 34, some of which are greater than one millimeter in diameter, can be collected from the slurry. A plurality of surfactants are employed in one or more embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Terms such as "above", "below", "top" and "bottom" are generally employed to indicate relative positions as opposed to relative elevations unless otherwise indicated. It should also be noted that, in some alternative implementations, the steps of the exemplary methods may occur out of the order noted in the figures. For example, two steps shown in succession may, in fact, be executed substantially concurrently, or certain steps may sometimes be executed in the reverse order, depending upon the functionality involved.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. A method comprising:

obtaining an aqueous slurry comprising a liquid and solid particles having diameters at least one millimeter within the liquid;

causing the formation of nanobubbles and collecting air bubbles within the aqueous slurry, the collecting air bubbles having diameters at least two orders of magnitude greater than the diameters of the nanobubbles, at least some of the nanobubbles being formed on or adhering to the solid particles;

causing gas supersaturation of the aqueous slurry;

monitoring gas density of the aqueous slurry using a gas density sensor and continuously controlling dissolved gas in the aqueous slurry to ensure that the nanobubbles do not collapse;

introducing a plurality of surfactants to the slurry;

causing one or more nanobubbles to adhere to the solid particles, and attaching the solid particles to the collecting air bubbles using capillary bridges formed by the nanobubbles between the solid particles and the collecting air bubbles, thereby causing the solid particles to rise within the slurry.

2. The method of claim 1, wherein the step of causing the formation of nanobubbles further includes forming the nanobubbles in a selected size range to facilitate recovery of the solid particles having diameters of at least one millimeter.

3. The method of claim 1, further including selectively attaching the nanobubbles to selected ones of the solid particles and the collecting air bubbles.

4. The method of claim 3, wherein the step of selectively attaching the nanobubbles includes adjusting the hydrophobicity of the selected ones of the solid particles.

5. The method of claim 1, further including adjusting the gas density based on feedback from the gas density sensor.

6. The method of claim 5, wherein the step of continuously controlling the dissolved gas in the aqueous slurry further includes the step of controlling temperature of the aqueous slurry and/or pressure exerted on the aqueous slurry.

7. The method of claim 5, further including the step of injecting nanobubbles coated with a specific surfactant into the aqueous slurry.

8. The method of claim 5, further including the steps of providing a flotation cell and introducing the aqueous slurry into the flotation cell.

9. The method of claim 8, further including the step of collecting the solid particles that rise within the slurry.

10. The method of claim 9, further including the step of continuously controlling the dissolved gas in the aqueous slurry by controlling temperature of the aqueous slurry and/or pressure within the flotation cell.

11. The method of claim 10, wherein the step of continuously controlling the dissolved gas in the aqueous slurry includes controlling the pressure within the flotation cell.

12. The method of claim 11, further including the step of maintaining the pressure within the flotation cell above atmospheric pressure.

* * * * *